US009958247B2

(12) United States Patent
Teowee et al.

(10) Patent No.: US 9,958,247 B2
(45) Date of Patent: May 1, 2018

(54) METHOD AND APPARATUS FOR LOGGING ELECTRONIC DETONATORS

(71) Applicant: Austin Star Detonator Company, Cleveland, OH (US)

(72) Inventors: Gimtong Teowee, Westlake Village, CA (US); Bryan E. Papillon, Phoenixville, PA (US); Larry S. Howe, Norwalk, OH (US)

(73) Assignee: Austin Star Detonator Company, Cleveland, OH (US)

( * ) Notice: Subject to any disclaimer, the term of this patent is extended or adjusted under 35 U.S.C. 154(b) by 13 days.

(21) Appl. No.: 15/059,958

(22) Filed: Mar. 3, 2016

(65) Prior Publication Data

US 2016/0187116 A1 Jun. 30, 2016

Related U.S. Application Data

(63) Continuation-in-part of application No. PCT/US2014/053824, filed on Sep. 3, 2014.
(Continued)

(51) Int. Cl.
*F42D 1/05* (2006.01)
*F42D 1/055* (2006.01)

(52) U.S. Cl.
CPC ..... *F42D 1/05* (2013.01); *F42D 1/055* (2013.01)

(58) Field of Classification Search
CPC ..... F23Q 21/00; F42C 15/40; F42C 15/42; F42C 21/00; F42D 1/05; F42D 1/055
See application file for complete search history.

(56) References Cited

U.S. PATENT DOCUMENTS 4,674,047 A 6/1987 Tyler et al.
6,618,237 B2 9/2003 Eddy et al.
(Continued)

FOREIGN PATENT DOCUMENTS

WO WO2001042732 A1 6/2001
WO WO2001067031 A1 9/2001
(Continued)

OTHER PUBLICATIONS

International Preliminary Examination Report and Written Opinion, PCT/US2014/053824; dated Mar. 17, 2016; Issued Mar. 8, 2016; Authorized Officer Nora Lindner, Int'l Bureau, 7 pgs.
(Continued)

*Primary Examiner* — Stephen Johnson
(74) *Attorney, Agent, or Firm* — Fay Sharpe LLP

(57) ABSTRACT

Logging apparatus, methods and systems are presented for logging data from electronic detonators one at a time, in which a logger is placed into an automatic logging mode and begins transmitting read request messages in repetitive fashion until a response is received from a single connected electronic detonator, whereupon the logger obtains serial ID number and potentially other data such as a delay from the electronic detonator, after which the logger automatically proceeds without further user button presses to again initiate read request messages, by which a user can sequentially connect and disconnect a number of electronic detonators one at a time for quick expeditious logging. Also presented are automatic electronic detonator programming apparatus and processes in which a logger is placed into an automatic programming mode and the user connects electronic detonators one at a time for automatic or semi-automatic programming of delay times from internal memory.

26 Claims, 5 Drawing Sheets

Related U.S. Application Data

(60) Provisional application No. 61/874,392, filed on Sep. 6, 2013.

(56) References Cited

U.S. PATENT DOCUMENTS

| | | | | |
|---|---|---|---|---|
| 6,644,202 | B1 | 11/2003 | Duniam et al. | |
| 6,789,483 | B1 | 9/2004 | Jennings, III et al. | |
| 6,938,689 | B2 | 9/2005 | Farrant et al. | |
| 6,945,174 | B2 | 9/2005 | Aebi et al. | |
| 7,174,832 | B1 | 2/2007 | Shann | |
| 7,322,293 | B2 * | 1/2008 | Kouznetsov | F42B 3/122 102/206 |
| 7,533,613 | B2 | 5/2009 | Kouznetsov | |
| 7,594,471 | B2 | 9/2009 | Koekemoer et al. | |
| 7,617,715 | B2 | 11/2009 | Georgeson et al. | |
| 7,650,841 | B2 | 1/2010 | McClure et al. | |
| 7,681,500 | B2 | 3/2010 | Teowee | |
| 7,791,858 | B2 | 9/2010 | Hummel et al. | |
| 7,870,825 | B2 | 1/2011 | Teowee | |
| 7,911,760 | B2 | 3/2011 | Lownds | |
| 8,390,979 | B2 | 3/2013 | Hurley et al. | |
| 8,395,878 | B2 | 3/2013 | Stewart et al. | |
| 8,439,106 | B2 | 5/2013 | Hammami et al. | |
| 2005/0103219 | A1 | 5/2005 | McClure et al. | |
| 2006/0272536 | A1 | 12/2006 | Lownds et al. | |
| 2008/0098921 | A1 | 5/2008 | Labuschagne et al. | |
| 2008/0236432 | A1 * | 10/2008 | Teowee | F42D 1/055 102/215 |
| 2010/0180788 | A1 | 7/2010 | Hummel et al. | |
| 2011/0083574 | A1 | 4/2011 | LeVan et al. | |
| 2012/0242135 | A1 | 9/2012 | Thomson et al. | |
| 2014/0026775 | A1 * | 1/2014 | Papillon | F42D 1/055 102/215 |

FOREIGN PATENT DOCUMENTS

| | | | |
|---|---|---|---|
| WO | WO 2007/124538 | A1 | 11/2007 |
| WO | WO2011046907 | A3 | 4/2011 |
| WO | WO2015034882 | A1 | 3/2015 |

OTHER PUBLICATIONS

Extended European Search Report of European Application No. 14842686.9-1655 / 3042147 dated Mar. 15, 2017, 8 pgs.

Orica: "I-kon electronic blasting system", Nov. 5, 2010 (Nov. 5, 2010), XP002767820, Retrieved from the Internet: URL:https://www.oricaminingservices.com/uploads/TDS/i-kon%20Electronic%20Blasting%20System_TDS_2010-11-05_en-_Norway.pdf, [retrieved on Mar. 23, 2017, 2 pgs.

International Search Report and Written Opinion, PCT/US2014/053824; dated Dec. 30, 2014; Completed Nov. 14, 2014; Authorized Officer Blaine R. Copenheaver, ISA/US, 8 pgs.

E*Star Seismic Detonators, "Electronic Programmable Detonators", Austin Powder Company, Product Data Sheet, Sep. 8, 2009, 5 pgs.

E*Star Product Bulletin, "Electric Detonator With Electronic Timing", Austin Power Int'l., Product Data Sheet, May 31, 2012, 2 pgs.

Verakis et al., "Evaluation of Austin Electro*Star (E*Star) Electronic Detonator Blasting System—Requirements for Shunting & Circuit Testing", Mar. 2007, United States Department of Labor, Mine Safety and Health Administration, 25 pgs.

* cited by examiner

METHOD AND APPARATUS FOR LOGGING ELECTRONIC DETONATORS

REFERENCE TO RELATED APPLICATIONS

This application is a continuation-in-part of, and claims priority to and the benefit of, International Application No PCT/US2014/053824, filed Sep. 3, 2014 and entitled "METHOD AND APPARATUS FOR LOGGING ELECTRONIC DETONATORS", the entirety of which is hereby incorporated by reference. This application claims priority to and the benefit of U.S. Provisional Application No. 61/874,392, filed Sep. 6, 2013 and entitled "METHOD AND APPARATUS FOR LOGGING ELECTRONIC DETONATORS", the entirety of which is hereby incorporated by reference.

TECHNICAL FIELD

The present disclosure involves blasting technology in general, and particularly relates to electronic detonator logging techniques and apparatus.

BACKGROUND

In blasting operations, detonators and explosives are buried in the ground, for example, in holes (e.g., bore holes) drilled into rock formations, etc., and the detonators are wired for external access to blasting machines that provide electrical signaling to initiate detonation of explosives. Electronic detonators have been developed which implement programmable delay times such that an array of detonators can be actuated in a controlled sequence. Such electronic detonators typically include an internally stored unique identification number, referred to herein as a detonator serial ID number, and logger devices can be used to program individual electronic detonators with a corresponding delay time according to a blasting plan. Within a given blasting plan, each detonator may be assigned a "detonator number" or "detonator ID", typically corresponding to a given location or position within a blasting site. In many applications, a blasting site can include hundreds or even thousands of electronic detonators located in a large number of holes, which are referred to herein as positions.

Electronic detonator data for a given blasting site is often logged using one or more loggers, which do not include the capability to fire the detonators being logged. In certain contexts the logging may be performed many weeks or months before blasting occurs, and the electronic detonators may be logged one at a time as they are individually connected to the logger device. Logging, moreover, can involve programming delay values into the individual detonators, and may further involve assignment of the detonator ID for a given blasting plan. Certain electronic detonators have been developed, in which logging of electronic detonators may involve an operator connecting each detonator, and pressing buttons or keys on the logger to read the detonator data, which can include the serial ID number, any assigned detonator ID according to a blasting plan, as well as any delay time. Conventional electronic detonator logging can be time-consuming, with the user being required to connect each detonator, interact with the user interface of the logger to initiate individual read operations, as well as any programming and programmed data verification operations, typically involving navigating through prompt screens on the logger. In a large blasting operation having thousands of detonators, conventional logging can take several hours, even where multiple loggers are used, and this process is further lengthened if the delay time needs to be program specifically at each detonator according to a blast program, where the delay programming typically involves several additional keystrokes per detonator.

Thus, conventional electronic detonator logging processes are time-consuming, and thus costly in terms of manpower. Optical scanning of tags or other visible indicia on a detonator is possible, and sometimes quick, but there is no electrical interface in such technology between the logger and the electronics inside the detonator. Moreover, at the end of logging, the detonators cannot be checked electrically to make sure they are all present on a branch line where only optical scanning of tag data is used. In certain situations, delay times can be downloaded to a logger, for example, based on a logical time sequence, and the logger is subsequently connected to the individual electronic detonators and is used to program the corresponding delay times to the individual detonators during logging. Again, however, conventional loggers require an operator to initiate multiple keystrokes to program the delay times and upload the detonator data into the logger, even where the delay time is obtained from memory.

Furthermore, situations may arise where conventional logging is performed on electronic detonators, where the detonators are programmed individually with their respective delay times, but the logger used to log these electronic detonators may be lost, or its internal detonator data may be corrupted or damaged. In such situations, it is common to again log the electronic detonators (e.g., one at a time, or by accessing a single circuit to which multiple detonators are connected) in order to retrieve all the detonator data for subsequent transfer to a blasting machine. However, even where no delay programming is involved, such logging using conventional loggers requires an operator to manipulate the logger user interface keys or buttons several times for each electronic detonator. Accordingly, there is a need for improved electronic detonator logging and delay programming techniques and apparatus to facilitate expeditious and safe logging of detonator data.

SUMMARY

Various aspects of the present disclosure are now summarized to facilitate a basic understanding of the disclosure, wherein this summary is not an extensive overview of the disclosure, and is intended neither to identify certain elements of the disclosure, nor to delineate the scope thereof. Instead, the primary purpose of this summary is to present some concepts of the disclosure in a simplified form prior to the more detailed description that is presented hereinafter.

The disclosure relates to systems, methods and apparatus for logging electronic detonators, by which the above and other difficulties and problems can be mitigated or overcome. Loggers and logging techniques are provided in which a logger is placed into an automatic logging mode where the logger provides a continuous or repeating series of read requests until an electronic detonator is connected and successfully replies to the read requests. Alternatively the logger only reads automatically in response to sensing a current draw upon connecting a detonator to the logger. The logger obtains any programmed data from the detonator, including serial ID number, any assigned detonator ID, and/or any delay time, and may provide an audible or vibratory indication and/or screen notification indicating to the user that the currently-connected electronic detonator data has been logged and can be disconnected for subsequent connection of another detonator. By this technique, the user may quickly connect individual electronic detonators to the logger without having to interact unnecessarily with the keypad buttons or other user interface features of the logger, thereby significantly expediting electronic detonator logging. Expeditious automatic programming logger devices and methods are also disclosed, in which a logger is placed into an automatic programming mode to continuously or repetitively issue read requests until an electronic detonator successfully responds, with the logger then automatically programming a delay time into the connected detonator from an internal memory, without requiring the user to press anymore logger buttons, by which a large number of electronic detonators may be programmed in an efficient manner.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
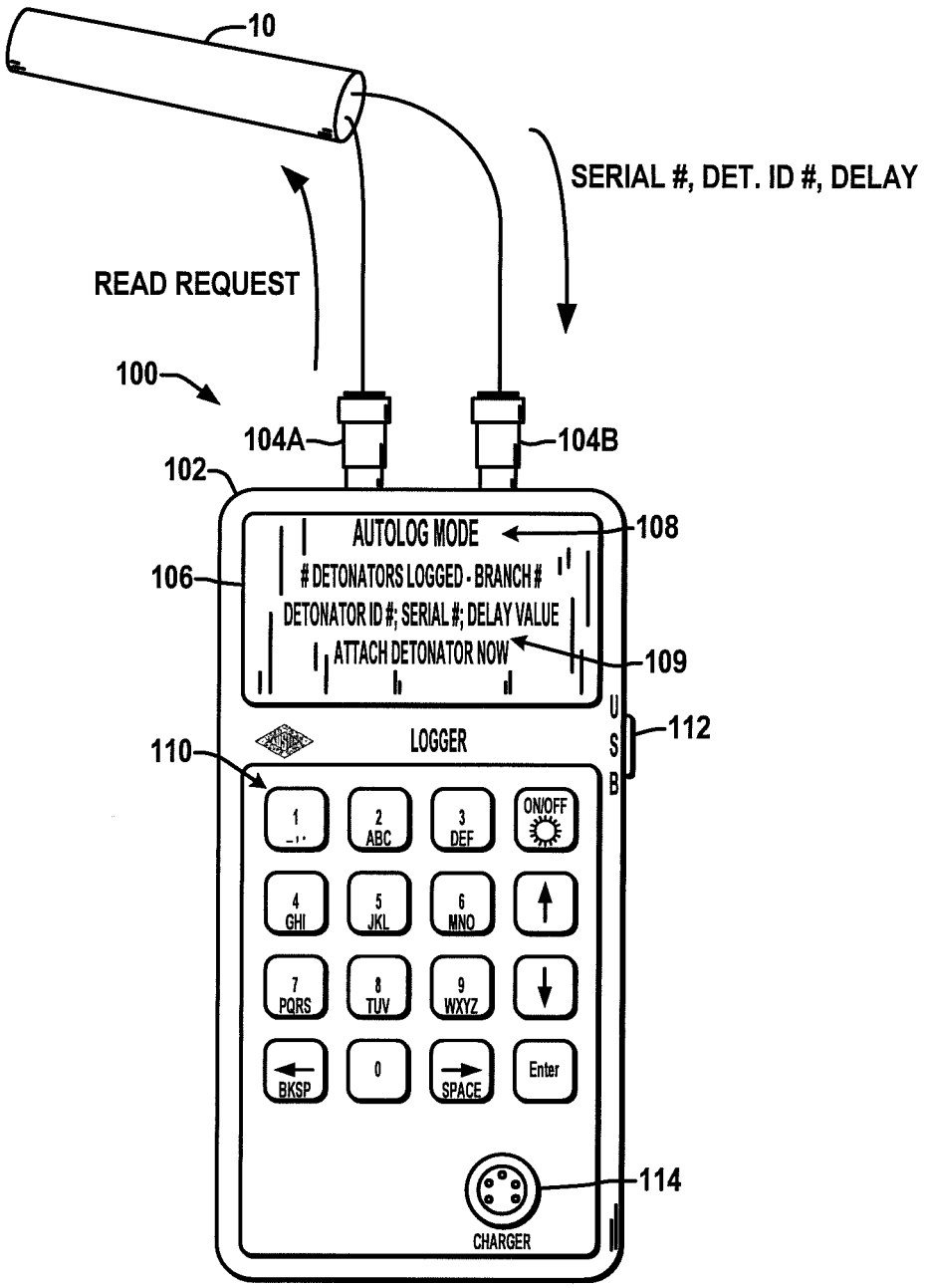
FIG. 1 is a front elevation view illustrating an exemplary logger apparatus for obtaining data from electronic detonators, and/or for programming electronic detonators, with minimal required user actions to expedite logging and/or delay programming in accordance with one or more aspects of the present disclosure.

Referring now to the figures, several embodiments or implementations of the present disclosure are hereinafter described in conjunction with the drawings, wherein like reference numerals are used to refer to like elements throughout, and wherein the various features are not necessarily drawn to scale. The disclosure relates to methods and logger apparatus for safe logging of detonator data and/or for safe programming of electronic detonator delay times.

Figure 2:
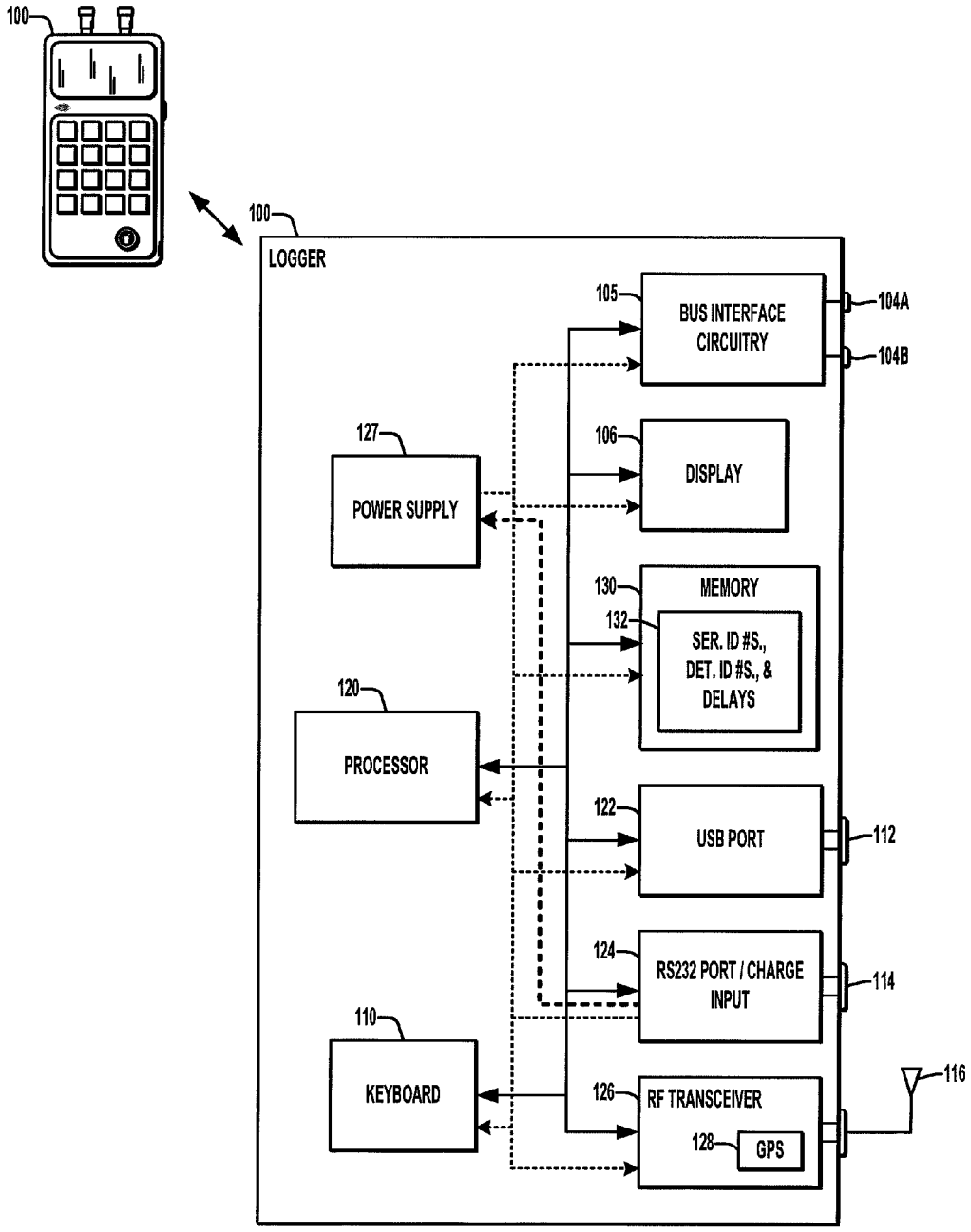
FIG. 2 is a schematic diagram illustrating further details of the exemplary logger of FIG. 1.

Referring initially to FIGS. 1 and 2, an exemplary logger apparatus 100 is shown connected via terminals 104A and 104B to wires of a single exemplary electronic detonator 10. The logger 100 includes interface circuitry 105 (FIG. 2) to communicate via suitable electronic messaging for exchanging electronic signaling and data between the logger 100 and the connected detonator 10, and the logger 100 may be further adapted to communicate with other loggers and blasting machines (not shown) using conventional communications protocols as are known. In operation, either automatically or through user command, the logger 100 will begin exchanging information with the connected detonator 10. As described further below, the illustrated logger 100 can be placed into special automatic modes for logging and/or programming, and the logger 100 provides suitable menu-driven options for a user to enter and exit these automatic modes. In one possible example, the detonator wires are connected to first and second field terminals 104A and 104B and the logger device 100 is powered on by the user.

The user utilizes one or more buttons on a keypad 110 according to options presented on a display 106 to enter an automatic logging mode ("AUTOLOG"), and the logger 100 is programmed to allow a user to exit this mode via one or more predefined keystrokes. Also, as described further below, the logger 100 is programmed for user-initiated entry and exit of an automatic programming mode ("AUTOPROGRAM"). In the automatic logging mode, the logger 100 sends a series of query or "read request" messages in repetitive fashion without requiring the user to otherwise interact with the user interface 106, 110. In this mode, the logger 100 automatically transmits read request messaging via the wires to the detonator 10, and the detonator 10, if properly connected and functioning, responds with one or more responsive messages or data packets (hereinafter "responsive messaging") including one or more of the detonator's unique serial ID number, any programmed detonator number are detonator ID, and/or any previously programmed delay time value. In the automatic logging and automatic modes, if two or more detonators 10 are connected to the wires, the logger 100 can detect responses from multiple detonators, and identifies such as "crosstalk", for example, by detecting cyclic redundancy code (CRC) errors in the responsive messaging, and will accordingly notify the user that more than one detonator 10 is connected. In certain implementations of the automatic logging and/or automatic programming concepts of present disclosure, as shown below, the detection of multiple detonators 10 will cause the logger 100 to refrain from performing any logging or until the situation is rectified. In other modes, the logger 100 may be operative to discriminate between multiple reply messages and from more than one detonator 10 connected to the terminals 104, and can determine the number of detonators 10 with which it is currently connected. In this respect, one possible suitable communication protocol can be implemented with the logger 100 operating as a master for communication along a pair of branch wires with multiple detonators 10 responding to identification request messages and thereafter to messages addressed individually according to the corresponding detonator serial ID numbers. Thus, if the device 100 is connected to a group of detonators 10 in certain modes, it will initially obtain the group of corresponding serial ID numbers from corresponding connected electronic detonators 10.

As best seen in FIGS. 1 and 2, the logger 100 includes a housing 102, preferably constructed to withstand the rigors of outdoor blasting site environments while providing externally accessible terminals 104 for connection with detonator wires. The logger 100 also includes a display 106 for rendering data and/or images to the user, and a keyboard or other input means 110, and preferably includes an audible annunciator, for example, to provide the user with an audible "beep" sound. In addition, the logger 100 may further include a vibratory indicator operable to selectively provide a vibratory notification to a user, for example, to indicate successful automatic logging and/or automatic programming of a connected detonator 10. The display 106 can be an LCD, LED, OLED, plasma display, fluorescent display, or any other suitable display technology can be used. In practice, due to the environmental nature of blasting operations, the display 106 preferably is able to operate at extreme temperatures such as −20° C. to +70° C. Moreover, the logger device 100 preferably includes a battery allowing field operation. The illustrated logger 100 also includes one or more communication interfaces for exchanging data with external devices, which may include various communications circuits such as a serial port or UART, USB, $I^2C$, SPI, etc. As seen in FIG. 2, for instance, the device 100 may include a USB port 112 with associated circuitry 122 within the housing 102, an externally-accessible RS-232 port connection 114 and associated interior circuitry 124, and/or the logger 100 may include wireless communication transceiver circuitry 126 with an external and/or internal antenna 116. In certain embodiments, moreover, the wireless transceiver 126 may be equipped with a GPS system 128 allowing the logger 102 obtain its current location (e.g., latitude, longitude and/or elevation) by suitable messaging with GPS satellites using known techniques.

The logger 100 in certain embodiments is battery-powered, and the RS-232 port 114 can be used to either connect the device for data exchange with a logger or other external device and/or for charging the internal battery (not shown). In certain embodiments, a nickel cadmium or lithium ion battery, a Ni metal hydride battery or alkaline cells can be used with voltage restrictions consistent with inherently safe or intrinsically safe operation. In other possible embodiments, a lead acid battery may be used. In this regard, power can be provided via the charge input 124 from an external device connected to the connector 114 (e.g., five pin connector 114 on the front face of the illustrated logger device 100 in FIG. 1) and provided to charging circuitry within a power supply 127 for charging an internal battery. In addition, the power supply 127 provides suitable AC and/or DC power at one or more levels to drive the various circuitry of the logger 100. In general, the various circuits and components shown in FIG. 2 may be implemented in a single or multiple circuit board configuration with suitable mounting in the interior of the housing 102, and external ports or connections can be provided for the detonator wiring connection terminals 104, a USB port 112, an RS-232 port/charge input connector 114 and/or for any external wireless antenna 116 (in certain embodiments a wireless antenna 116 may be implemented within the interior of the housing 102). Also, suitable electrical connections are provided from such circuit board(s) to the display 106 and to the keyboard 110 for receiving user input by way of key presses.

The logger 100 in certain embodiments is an inherently safe device for use by blasting personnel at a blasting site 200 without danger of accidentally actuating electronic detonators 10. In this regard, the interface circuitry 105 coupled with the detonator wire terminals 104 in certain embodiments is low-power circuitry and the logger 100 is not provided with suitable power, energy or voltage from the power supply 127 or elsewhere to initiate arming or firing of a connected electronic detonator 10. In addition, the logger apparatus 100 and components thereof are generally operated under control of a processor 120 (FIG. 2), and the processor 120 is unable to send any arming or firing commands to a connected electronic detonator 10 in the described automatic logging and automatic programming modes. In other possible embodiments, the logger apparatus 100 may be implemented in a logger or blasting machine, wherein blasting machine implementations need not be inherently safe, but may be operable in a "logger" mode in which the apparatus 100 will not generate sufficient voltage and/or current to cause actuation of an electronic detonator 200 and will not send any arming or firing commands to a detonator 10.

The processor 120 may be any suitable electronic processing device including without limitation a microprocessor, microcontroller, DSP, programmable logic, etc. and/or combinations thereof, which performs various operations by executing program code such as software, firmware, microcode, etc. The logger includes an electronic memory 130 which can store program code and/or data, including electronic storage 132 of detonator serial ID numbers, detonator numbers, for instance, corresponding to blast site position numbers, and detonator delay values. In certain embodiments, moreover, the memory 130 can also store corresponding geographic location data, such as latitude, longitude and/or elevation. The memory 130 may be any suitable form of electronic memory, including without limitation EEPROM, flash, SD, a multimedia card, and/or a USB flash drive operatively associated with the USB port 112 (FIG. 1). The memory 130 may store further information, including without limitation additional detonator numbers (a detonator number is a generic number within a blasting plan which is associated with one or more unique detonator serial ID numbers upon logging), a delay time value programmed into the corresponding detonator 10, and/or other status flags to facilitate logger operation. In this regard, the data store or file 132 can include data from detonators 10 logged using many different loggers 300 (FIG. 3), and such logging may be done at different times by different personnel, where some of the logged data in a blasting plan may include geographic location information and others may not. The processor 120 may be programmed to allow a user to access such data for display on the display 106 by using the keyboard 110.

Figure 3A:
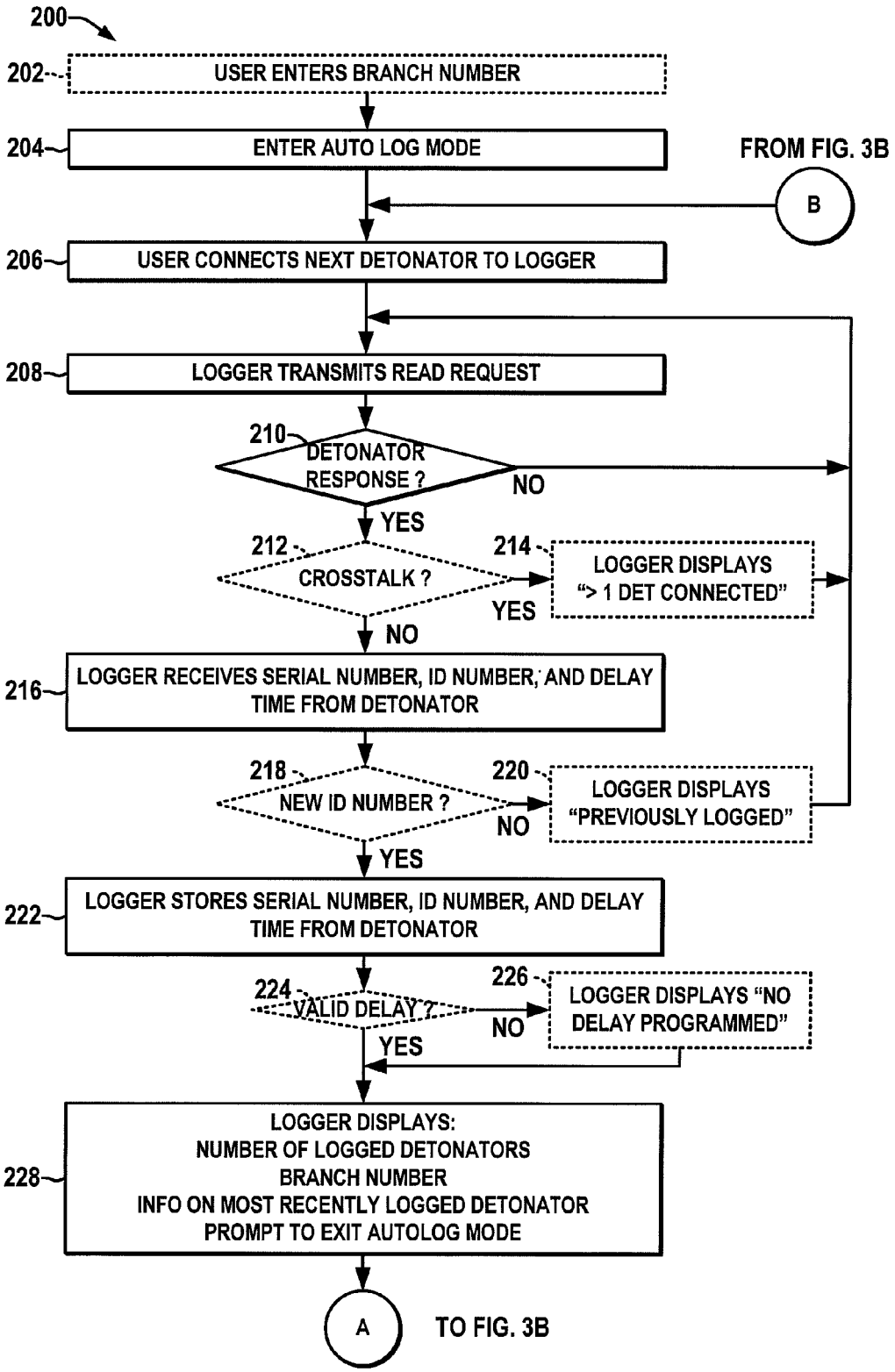
FIGS. 3A and 3B depict a flow diagram illustrating an exemplary method for logging electronic detonators with minimal user interaction according to further aspects of the disclosure.
Figure 3B:
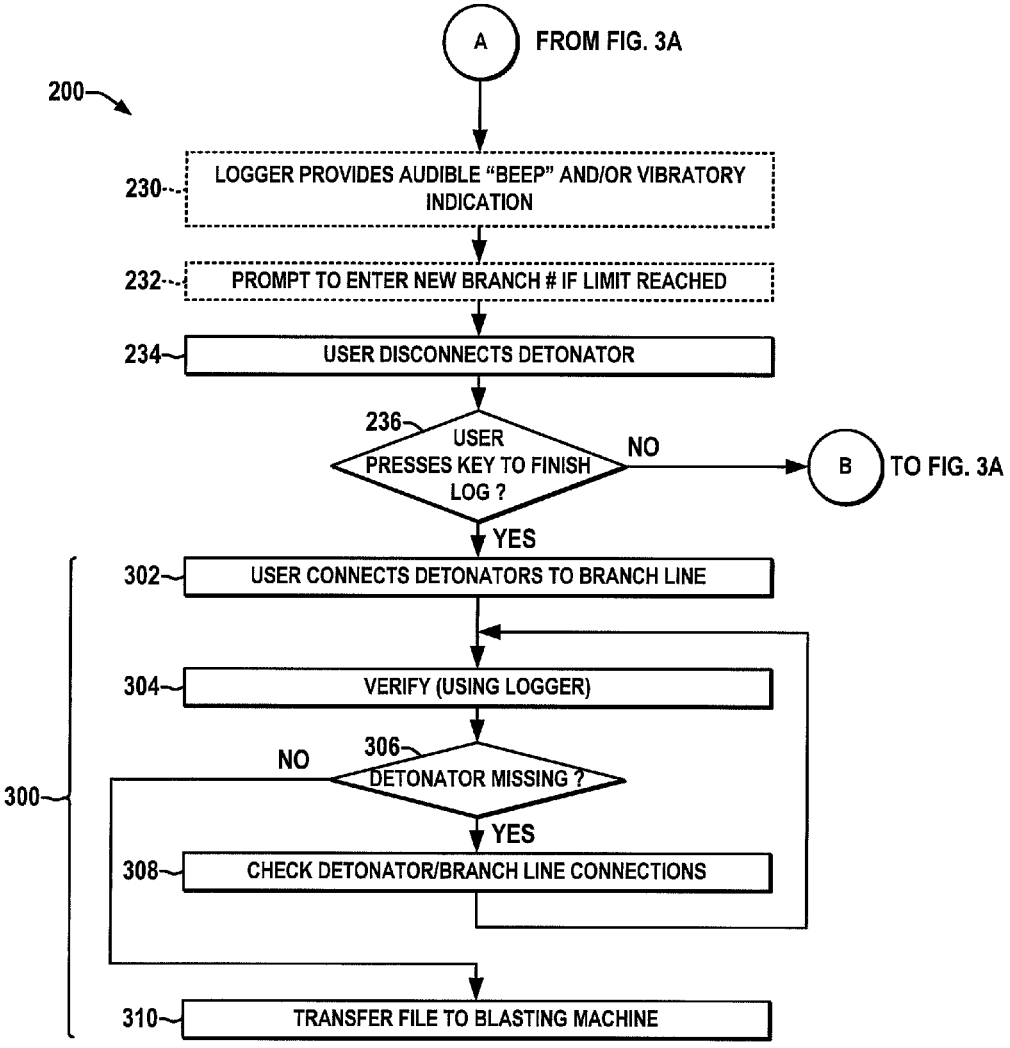

Referring also to FIGS. 3A and 3B, the logger 100 is operable in an automatic logging mode, where FIGS. 3A and 3B illustrate an exemplary logging method 200 which may be implemented using the logger 100 of FIGS. 1 and 2. Although the exemplary method 200 and other methods of this disclosure are illustrated and described hereinafter in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated method 200 and other methods of the disclosure may be implemented in hardware, processor-executed software, or combinations thereof, such as in the exemplary logger 100 described herein, and may be embodied in the form of computer executable instructions stored in a non-transitory computer readable medium.

FIGS. 3A and 3B illustrate operation of the logger 100 in an automatic logging mode, in which a user may optionally enter a branch number at 202 (FIG. 3A), and the user utilizes the keypad 110 to enter the automatic logging mode at 204, for example, by pressing a predefined button 110 and/or by actuating a predefined sequence of keystrokes, which may be prompted, in whole or in part, via suitable prompting messages on the display 106 under control of the processor 120. During operation in the automatic logging mode, moreover, the processor 120 may cause the display 106 to render certain information 108 and 109, such as a mode indicator 108 ("AUTOLOG MODE" in FIG. 1) as well as data 109 related to one or more electronic detonators 10 that have been automatically logged, for example, including the number of detonators logged, a current branch number, a detonator ID, a detonator serial number, and a delay value associated with a most recently logged detonator 10, wherein the display 106 may also provide an instruction to the user to attach another detonator (e.g., "ATTACH DETONATOR NOW").

In the illustrated embodiment, the processor 120 is programmed to maintain the logger 100 in the automatic logging mode until the user interacts with the user interface 106, 110 to exit the automatic logging mode. During operation in the automatic logging mode, moreover, the processor 120 operates in a generally continuous or repetitive fashion allowing a user to connect, log, and then disconnect individual detonators 10 via the terminals 104 of the logger 100 while issuing a series of read request messages until a response is received from a single connected detonator 10. At 206 in FIG. 3A, the user connects a detonator 10 to the logger 100, and the logger 100 transmits a read request at 208 via the electrical interface 104, 105. While operating in this mode, the logger 100 does not transmit any programming messaging to the connected detonator 10, and does not require user interaction with the keyboard 110 or the display 106. This advantageously saves a significant amount of user time in sequentially connecting, logging, and disconnecting electronic detonators 10, during which time the user does not need to press any buttons on the keyboard 10. The automatic logging mode finds utility in a variety of situations, including without limitation a quality control process in which detonators 10 are programmed by any suitable means, with quality inspection personnel utilizing a logger 100 in the automatic logging mode following and logging the programmed delay for verification with respect to a blasting plan or design timing sequence.

At 210 in FIG. 3A, the logger 100 determines whether a valid detonator response has been received, and if not (NO at 210), returns to transmit another read request message at 208. This operation continues with the logger 100 awaiting responsive messaging from the detonator 10 without transmitting any programming messaging to the connected electronic detonator 10 and without requiring user interaction with the user interface 106, 110. It is noted that the user, at any time, may initiate a mode change in the logger 100, for example, by pressing a dedicated key or a predefined sequence of keys on the keypad 110 in order to take the logger 100 out of the automatic logging mode. Without such mode change, the logger 100 continues issuing read request messages at 208 and 210 until a responsive message or messages is/are received from a connected detonator 10.

Once responsive messaging has been received by the logger 100 (YES at 210), the processor 120 may optionally be programmed to detect receipt of invalid communications at the electrical interface 104, 105 (at 212 and FIG. 3A), and if so (YES at 212) to provide an indication to the user at 214 (e.g., an audible beep alone or in combination with a message on the display 106) indicating that invalid communications have been received, again, without transmitting any programming messaging to the connected electronic detonator 10 and without requiring user interaction with the user interface 106, 110. In this regard, the provision of a display message and/or an audible tone by the logger 100 is not, in and of itself, interaction by the user, wherein the logger 100 performs the communication verification at 212 and 214 without requiring the user to press a key on the keypad 110 or to take any other action to cause the logger to verify the validity of the communications. Receipt of invalid communications can be determined in certain embodiments at 212 by the logger performing a CRC check on received messaging, wherein failure of a CRC check may be deemed to indicate that more than one detonator 10 is connected to the terminals 104, and the logger 100 in certain implementations may display this suspected condition to the user (e.g., ">1 DET CONNECTED") via the display 106. At this point, in the illustrated embodiment, the logger 100 returns to begin transmission of read request messages at 208 as described above, with the alerted user preferably verifying the connection of only a single electronic detonator 10 to the terminals 104.

Absent any cross talk detection at 212, the logger 100 receives one or more values, such as a detonator serial number, detonator ID and/or delay time from the detonator 10 at 216 in FIG. 3A. In one possible implementation, the logger 100 receives the data in the initial response from the detonator 10, although further message exchanging can be performed for this data acquisition. In certain implementations, the processor 120 performs a check of a received serial number and/or detonator ID at 218 to determine whether a serial ID number received in responsive messaging from the connected electronic detonator 10 was previously logged. If so (NO at 218), the logger 100 may display a message at 220 to the user via the display 106, such as "PREVIOUSLY LOGGED", and return to transmission of read request messages at 208. If the received ID has not been previously logged (YES at 218) the logger 100 stores the received detonator data (e.g., serial number, detonator ID number and/or delay time) in the electronic memory 130 at 222 in FIG. 3A. As previously noted, the repeated read requests and the receipt of the electronic detonator data, as well is the storage thereof in the memory 130 is performed by the logger 100 without transmission of any programming messaging to the connected detonator 10 and without requiring user interaction with the user interface 106, 110. Moreover, the logger 100 in certain embodiments is incapable of firing the detonator 10, whereby the automatic logging process 200 facilitates expeditious data acquisition from multiple electronic detonators 10 in a safe manner, with little or no user time spent pressing buttons on the keypad 110.

At 224 in FIG. 3A, the logger 100 in certain embodiments may also perform a check at 224 as to the validity of any received delay value from the detonator 10. For instance, if an electronic detonator 10 has not been previously programmed with any delay value, the detonator 10 may return a known default value (e.g., "901" in one implementation), and the logger 100 may detect such a condition, and display a message at 226 on the display 106 (e.g., "NO DELAY PROGRAMMED"). Alternatively, a status flag can be transferred from the detonator to the logger to indicate that the detonator does not have a delay value. Once the detonator data has been obtained and stored (i.e., logged), the logger 100 in certain implementations (e.g., 228 in FIG. 3A) displays the number of logged detonators, the branch number, as well as information on the most recently logged detonator (e.g., as shown in FIG. 1), and may also prompt the user with the option to exit the automatic logging mode in certain implementations, all without transmitting any programming messaging to the detonator 10 and without requiring user interaction with (i.e., actuation of) the user interface 106, 110.

Continuing in FIG. 3B, the logger 100 may optionally provide an audible or vibratory indication at 230 (e.g., "beep") to tell the user that the connected electronic detonator 10 has been logged, again without transmitting any programming messaging to the connected electronic detonator 10 and without requiring user interaction with the user interface, alone or in combination with the visual indication on the display 106 showing information related to the most-recently logged detonator 10. In certain implementations, the logger 100 may alternatively (or in combination) provide a vibratory indication at 230. At 232 in FIG. 3B, the logger 100 may optionally determine whether a maximum number of detonators per branch has been reached, and if so, prompt the user to enter a new branch number at 232. As seen, the automatic logging mode advantageously allows a user to focus on the connection and disconnection of electronic detonators 10, potentially simply listening for the confirmation "beep" sound, thereby logging a large number of detonators 10 in a short amount of time, with the entire process being initiated by the user entering the automatic logging mode by a single keystroke (e.g., 1-touch logging).

At 234, the user disconnects the current detonator, and the user may optionally press one or more keys to complete the logging at 236 (e.g. to exit the automatic logging mode). If not (NO at 236), the process 200 returns to 206 in FIG. 3A, where the user connects the next detonator 10 to the logger 100, and the automatic logging mode operation continues in this fashion as described above until the user exits the automatic logging mode (YES at 236 in FIG. 3B). Thereafter, further operations 300 may be undertaken in a typical implementation, with a user connecting multiple detonators 10 to a branch line (not shown) at 302, and verifying at 304 (possibly using the same logger 100) that each logged detonator 10 is connected to the branch line. If any logged detonators are not identified on the branch line (missing detonator determined at 306 "YES"), the user checks the detonator/branch line connections at 308, and again verifies the branch line at 304. If no detonators are missing (NO at 306), the logged data file is transferred to a blasting machine at 310.

Figure 4:
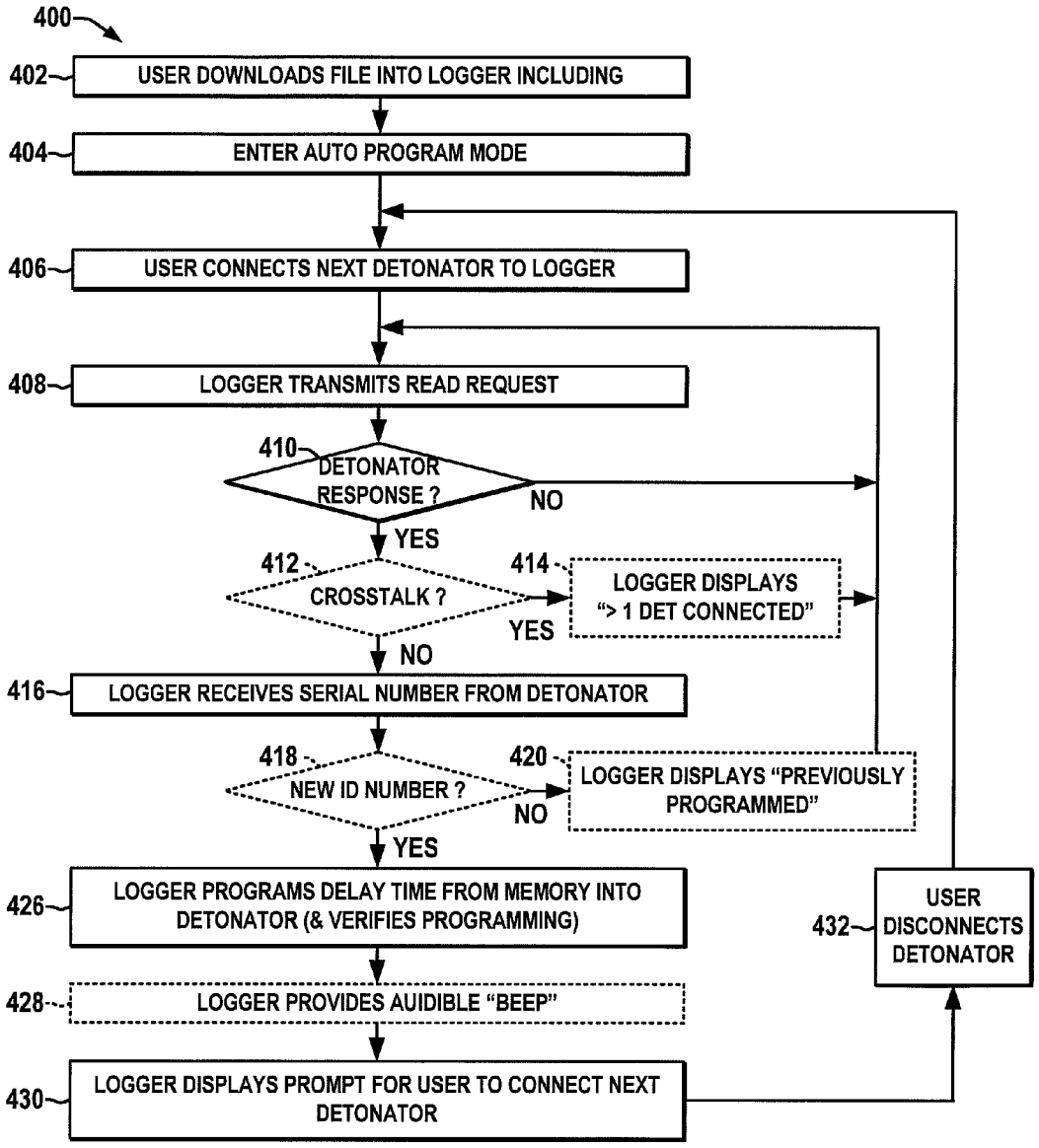
FIG. 4 is a flow diagram illustrating an exemplary method for automatically programming delay times in electronic detonators in accordance with further aspects of the present disclosure.

Referring now to FIG. 4, the logger 100 may also be operable in an automatic programming mode, for example, for programming delay times into a series of electronic detonators 10 based on a previously stored data file in the electronic memory 130 of the logger 100. In this regard, logger apparatus 100 may be provided which implements either or both of the illustrated and described automatic logging and automatic programming modes. FIG. 4 illustrates an automatic programming process or method 400, in which a user downloads a data file at 402 into the logger 100 (e.g., file 132 into the electronic memory 130 in FIG. 2 above), which may include detonator numbers and/or detonator serial numbers, and corresponding delay values in one possible implementation. At 404, the user presses a dedicated key on the keypad 110 and/or initiates a predefined sequence of keystrokes on the keypad 110 (possibly in conjunction with suitable menu-driven prompting on the display 106) in order to place the logger 100 into the automatic programming mode. At 406, the user connects a detonator 10 to the logger 100 (e.g., as shown in FIG. 1 above).

For automatic programming ("AUTOPROGRAM"), the processor 120 of the logger 100 transmits one or more read request messages at 408 via the interface 104 and 105, and awaits responsive messaging at 410 from the connected electronic detonator 10, again without transmitting any programming messaging to the connected electronic detonator 10 and without requiring user interaction with the user interface 106, 110. As with the above automatic logging mode, if no responsive messaging is received (NO at 410), the process returns again to issue another read request message at 408.

Upon receiving responsive messaging from the connected electronic detonator 10 (YES at 410), the logger 100 in certain embodiments may check for crosstalk (e.g., CRC. errors) at 412, and issue any necessary display messages at 414 to tell the user that more than one detonator 10 is connected. If no crosstalk is detected (NO at 412), the logger 100 automatically receives a serial number at 416 from the detonator. In certain implementations, the logger 100 may optionally check at 418 whether the received ID number serial number or a received status flag indicates that the detonator 10 has previously been programmed by this or another logger 100, in which case, the logger 100 displays "PREVIOUSLY PROGRAMMED" on the display 106, and returns to 408 to continue transmission of read requests, for communicating with a subsequently connected different detonator 10. If the detonator 10 was not previously programmed (YES at 418), the logger 100 then programs the delay time (and possibly other information) from the internal file 132 of the memory 130 into the detonator 10, by sending a delay value programming message to the detonator 10 at 426, and the logger 100 optionally may issue an audible "beep" sound or other audible indication at 428 to tell the user that the programming message has been sent to the detonator 10. At 430, the logger 100 displays a prompt on the display screen 106 to request the user to connect the next detonator 10. At 432 in FIG. 4, the user disconnects the current detonator 10, and proceeds to connect the next detonator 10 to the logger 100 at 406 as described above.

In certain examples, the logger 100 is programmed to allow a user to program the same delay time in a defined number of detonators 10 using a single touch. The user enters the desired delay time and the number of detonators 10 to receive this delay. The detonators are programmed and logged with one touch of one of the keys or buttons of the user interface 110 on the face of the logger 100. The display 106 counts down between detonators 10 to show how many more are left, and the display 106 shows that it is done when the correct quantity have been programmed. This feature is advantageous in a variety of applications, including tunnel blasting.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software and/or firmware, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

The following is claimed:

1. A logger for safe logging of electronic detonator data, comprising:

an electrical interface allowing electrical connection of an electronic detonator to the logger to send and receive electrical signals to and from the electronic detonator, but incapable of providing sufficient energy to fire the electronic detonator;

a user interface;

an electronic memory operative to store a plurality of unique detonator serial ID numbers and corresponding delay values; and at least one processor operatively coupled with the electrical interface, the user interface, and the electronic memory, the at least one processor being programmed to operate the logger in an automatic logging mode in which the logger:

(i) transmits one or more read request messages via the electrical interface without transmitting any programming messaging to a single connected electronic detonator and without requiring user interaction with the user interface, (ii) awaits responsive messaging from the single connected electronic detonator without transmitting any programming messaging to the connected electronic detonator and without requiring user interaction with the user interface, and (iii) upon receiving responsive messaging from only the single connected electronic detonator:

obtains electronic detonator data including at least one of a serial ID number, a programmed detonator ID, and/or a delay value from the responsive messaging without transmitting any programming messaging to the connected electronic detonator and without requiring user interaction with the user interface, and stores the electronic detonator data in the electronic memory without transmitting any programming messaging to the connected electronic detonator and without requiring user interaction with the user interface, and thereafter (iv) repeats (i), (ii) and (iii) for a subsequently singly connected electronic detonator without transmitting any programming messaging to the connected electronic detonator and without requiring user interaction with the user interface.

2. The logger of claim 1, wherein the at least one processor is programmed to provide an indication to the user via the user interface that the connected electronic detonator has been logged during operation in the automatic logging mode without transmitting any programming messaging to the connected electronic detonator and without requiring user interaction with the user interface.

3. The logger of claim 2, wherein the at least one processor is programmed to provide an audible indication to the user that the connected electronic detonator has been logged during operation in the automatic logging mode without transmitting any programming messaging to the connected electronic detonator and without requiring user interaction with the user interface.

4. The logger of claim 2, wherein the at least one processor is programmed to provide a visible indication to the user using a display of the user interface to indicate that the connected electronic detonator has been logged during operation in the automatic logging mode without transmitting any programming messaging to the connected electronic detonator and without requiring user interaction with the user interface.

5. The logger of claim 2, wherein the at least one processor is programmed to provide a vibratory indication to the user that the connected electronic detonator has been logged during operation in the automatic logging mode without transmitting any programming messaging to the connected electronic detonator and without requiring user interaction with the user interface.

6. The logger of claim 1, wherein the at least one processor is programmed to remain in the automatic logging mode until the user interacts with the user interface to exit the automatic logging mode.

7. The logger of claim 1, wherein the at least one processor is programmed to detect receipt of invalid communications at the electrical interface, and to provide an indication to the user indicating that invalid communications at the electrical interface, via the user interface during operation in the automatic logging mode without transmitting any programming messaging to the connected electronic detonator and without requiring user interaction with the user interface.

8. The logger of claim 1, wherein the at least one processor is programmed to determine whether a serial ID number received in responsive messaging from the connected electronic detonator has been previously logged, and if so, to provide an indication to the user indicating that the connected electronic detonator has previously been logged via the user interface during operation in the automatic logging mode without transmitting any programming messaging to the connected electronic detonator and without requiring user interaction with the user interface.

9. The logger of claim 1, wherein the at least one processor is programmed to determine whether a delay value received in responsive messaging from the connected electronic detonator is valid, and if not, to provide an indication to the user indicating that no valid delay value has been programmed in the connected electronic detonator via the user interface during operation in the automatic logging mode without transmitting any programming messaging to the connected electronic detonator and without requiring user interaction with the user interface.

10. The logger of claim 1, wherein the at least one processor is programmed to determine whether a status flag received in responsive messaging from the connected electronic detonator indicates that the connected detonator does not have a delay value, and to provide an indication to the user indicating that no valid delay value has been programmed in the connected electronic detonator via the user interface during operation in the automatic logging mode without transmitting any programming messaging to the connected electronic detonator and without requiring user interaction with the user interface.

11. The logger of claim 1, wherein the at least one processor is programmed to cause the logger to transmit the one or more read request messages via the electrical interface responsive to sensing that the detonator is connected to the electrical interface during operation in the automatic logging mode without transmitting any programming messaging to the connected electronic detonator and without requiring user interaction with the user interface.

12. The logger of claim 1, wherein the at least one processor is programmed to allow the user to program a same delay time in a defined number of detonators using a single touch of a button of the user interface, wherein the at least one processor is programmed to allow the user to enter a desired delay time value and a number of detonators to receive the delay value, wherein the least one processor is programmed to allow the user to program and log each individual detonator with one touch of the button of the user interface, and wherein a display of the user interface renders a count value that counts down as each detonator is programmed to show how many single touch programmings are left.

13. A logger for programming electronic detonators, comprising:

an electrical interface allowing electrical connection of an electronic detonator to the logger to send and receive electrical signals to and from an electronic detonator, but incapable of providing sufficient energy to fire the electronic detonator;

a user interface;

an electronic memory operative to store a plurality of detonator ID numbers and corresponding delay values; and at least one processor operatively coupled with the electrical interface, the user interface, and the electronic memory, the at least one processor being programmed to operate the logger in an automatic programming mode in which the logger:

(i) transmits one or more read request messages via the electrical interface without transmitting any programming messaging to the connected electronic detonator and without requiring user interaction with the user interface, (ii) awaits responsive messaging from a single connected electronic detonator without transmitting any programming messaging to the connected electronic detonator and without requiring user interaction with the user interface, and (iii) upon receiving responsive messaging from only a single connected electronic detonator, automatically transmits a delay value programming message to the connected electronic detonator according to a delay value stored in the electronic memory without requiring user interaction with the user interface, and thereafter (iv) repeats (i), (ii) and (iii) for a subsequently singly connected electronic detonator without requiring user interaction with the user interface.

14. The logger of claim 13, wherein the at least one processor is programmed to provide an indication to the user via the user interface that the connected electronic detonator has been programmed during operation in the automatic programming mode without requiring user interaction with the user interface.

15. The logger of claim 14, wherein the at least one processor is programmed to provide an audible indication to the user that the connected electronic detonator has been programmed during operation in the automatic programming mode without requiring user interaction with the user interface.

16. The logger of claim 14, wherein the at least one processor is programmed to provide a visible indication to the user using a display of the user interface to indicate that the connected electronic detonator has been programmed during operation in the automatic programming mode without requiring user interaction with the user interface.

17. The logger of claim 14, wherein the at least one processor is programmed to provide a vibratory indication to the user to indicate that the connected electronic detonator has been programmed during operation in the automatic programming mode without requiring user interaction with the user interface.

18. The logger of claim 13, wherein the at least one processor is programmed to remain in the automatic programming mode until the user interacts with the user interface to exit the automatic programming mode.

19. The logger of claim 13, wherein the at least one processor is programmed to detect receipt of invalid communications at the electrical interface, and to provide an indication to the user indicating that invalid communications at the electrical interface, via the user interface during operation in the automatic logging mode without transmitting any programming messaging to the connected electronic detonator and without requiring user interaction with the user interface.

20. The logger of claim 13, wherein the at least one processor is programmed to determine whether a serial ID number or a status flag or flags received in responsive messaging from the connected electronic detonator has been previously logged, and if so, to provide an indication to the user indicating that the connected electronic detonator has previously been logged via the user interface during operation in the automatic logging mode without transmitting any programming messaging to the connected electronic detonator and without requiring user interaction with the user interface.

21. The logger of claim 13, wherein the at least one processor is programmed to operate the logger in an automatic logging mode, separate from the automatic programming mode, during which automatic logging mode the logger:

(a) transmits one or more read request messages via the electrical interface without transmitting any programming messaging to the single connected electronic detonator and without requiring user interaction with the user interface, (b) awaits responsive messaging from a single connected electronic detonator without transmitting any programming messaging to the single connected electronic detonator and without requiring user interaction with the user interface, and (c) upon receiving responsive messaging from only the single connected electronic detonator:

obtains electronic detonator data including at least one of a serial ID number, a programmed detonator ID, and/or a delay value from the responsive messaging without transmitting any programming messaging to the single connected electronic detonator and without requiring user interaction with the user interface, and stores the electronic detonator data in the electronic memory without transmitting any programming messaging to the single connected electronic detonator and without requiring user interaction with the user interface, and thereafter (d) repeats (a), (b) and (c) for a subsequently singly connected electronic detonator without transmitting any programming messaging to the connected electronic detonator and without requiring user interaction with the user interface.

22. The logger of claim 21, wherein the at least one processor is programmed to cause the logger to transmit the one or more read request messages via the electrical interface responsive to sensing current flow at the electrical interface indicating that the single connected detonator is connected to the electrical interface during operation in the automatic logging mode without transmitting any programming messaging to the connected electronic detonator and without requiring user interaction with the user interface.

23. The logger of claim 13, wherein the at least one processor is programmed to cause the logger to automatically transmit at least one status flag to the single connected electronic detonator to indicate that the single connected electronic detonator has been automatically programmed without requiring user interaction with the user interface.

24. A method for logging electronic detonator data, the method comprising:

(i) a user connecting only a single electronic detonator to a logger that is incapable of providing sufficient energy to fire the single connected electronic detonator;

(ii) the logger automatically transmitting one or more read request messages from the logger to the single connected electronic detonator without transmitting any programming messaging to the single connected electronic detonator and without requiring user interaction with a user interface of the logger;

(iii) the logger awaiting responsive messaging from the single connected electronic detonator without transmitting any programming messaging to the single connected electronic detonator and without requiring user interaction with the user interface; and (iv) the logger, upon receiving responsive messaging from only the single connected electronic detonator:

automatically obtaining electronic detonator data including at least one of a serial ID number, a programmed detonator ID, and/or a delay value from the responsive messaging without transmitting any programming messaging to the single connected electronic detonator and without requiring user interaction with the user interface, and automatically storing the electronic detonator data in an electronic memory of the logger without transmitting any programming messaging to the single connected electronic detonator and without requiring user interaction with the user interface;

(v) the user, disconnecting the single electronic detonator from the logger; and (vi) repeating (i), (ii), (iii), (iv) and (v) for a subsequently singly connected electronic detonator without transmitting any programming messaging to the connected electronic detonator and without requiring user interaction with the user interface.

25. The method of claim 24, comprising automatically transmitting the one or more read request messages from the logger to the single connected electronic detonator responsive to sensing current flow at the logger indicating that the single connected detonator is connected to the logger without transmitting any programming messaging to the single connected electronic detonator and without requiring user interaction with a user interface of the logger.

26. A system for logging electronic detonator data, comprising:

a plurality of electronic detonators; and a logger, the logger comprising:

an electrical interface allowing electrical connection of one of the electronic detonators to the logger to send and receive electrical signals to and from the electronic detonator, but incapable of providing sufficient energy to fire the electronic detonator;

a user interface;

an electronic memory operative to store a plurality of unique detonator serial ID numbers and corresponding delay values; and at least one processor operatively coupled with the electrical interface, the user interface, and the electronic memory, the at least one processor being programmed to operate the logger in an automatic logging mode in which the logger:

(i) transmits one or more read request messages via the electrical interface without transmitting any programming messaging to the connected electronic detonator and without requiring user interaction with the user interface, (ii) awaits responsive messaging from a single connected electronic detonator without transmitting any programming messaging to the single connected electronic detonator and without requiring user interaction with the user interface, and (iii) upon receiving responsive messaging from only the single connected electronic detonator:

obtains electronic detonator data including at least one of a serial ID number, a programmed detonator ID, and/or a delay value from the responsive messaging without transmitting any programming messaging to the single connected electronic detonator and without requiring user interaction with the user interface, and stores the electronic detonator data in the electronic memory without transmitting any programming messaging to the single connected electronic detonator and without requiring user interaction with the user interface, and thereafter (iv) repeats (i), (ii) and (iii) for a subsequently singly connected electronic detonator without transmitting any programming messaging to the connected electronic detonator and without requiring user interaction with the user interface.

* * * * *